US005688044A

United States Patent [19]

Watanabe et al.

[11] Patent Number: 5,688,044

[45] Date of Patent: Nov. 18, 1997

[54] VEHICULAR LAMP HAVING IMPROVED LIGHT DISTRIBUTION PATTERN

[75] Inventors: Saburo Watanabe; Takaaki Nishizawa, both of Shizuoka, Japan

[73] Assignee: Koito Manufacturing Co., Ltd., Tokyo, Japan

[21] Appl. No.: 689,077

[22] Filed: Jul. 30, 1996

[30] Foreign Application Priority Data

Jul. 31, 1995 [JP] Japan ..... 7-214034

[51] Int. Cl.[6] ..... F21V 7/00

[52] U.S. Cl. ..... 362/309; 312/338; 312/83

[58] Field of Search ..... 362/300, 268, 362/83, 61, 309, 338

[56] References Cited

U.S. PATENT DOCUMENTS 4,577,260 3/1986 Tysoe ..... 362/268

5,081,564 1/1992 Mizoguchi et al. ..... 362/268

*Primary Examiner*—Carroll B. Dority

*Attorney, Agent, or Firm*—Sughrue, Mion, Zinn, Macpeak & Seas, PLLC

[57] ABSTRACT

A fog lamp or the like which provides a desired light distribution pattern by means of horizontally diffusing lens steps formed in a lens in the case either where a downward curve is provided in the outer end portion of the lens disposed in front of a reflector and inclined in right and left directions, and where reflected light enters the outer end portion of the lens diagonally from the rear. Horizontally diffusing lens steps situated in the outer end portion of the lens are formed in such a manner that, when the lens is viewed from ahead of the lamp, they are not seen extending in the perpendicular direction like the horizontally diffusing lens steps situated in the other portions of the lens, but appear curved and shifted from top toward bottom inwardly in the vehicle width direction while their right and left widths are narrowed. This allows the horizontally diffusing lens steps to be seen extending in the perpendicular direction when they are viewed from the entering direction of the reflected light. As a result the reflected light entering the horizontally diffusing lens steps passes and spreads therethrough without being inclined with respect to the horizontal direction.

6 Claims, 9 Drawing Sheets

VEHICULAR LAMP HAVING IMPROVED LIGHT DISTRIBUTION PATTERN

BACKGROUND OF THE INVENTION

The present invention relates to a lamp for vehicular use, for example, a fog lamp for use on an automobile. More particularly, the invention relates to a lens employed with such a lamp which has an improved light distribution function.

In recent years vehicular lamps have been constructed such that the outer surface thereof is flush with the adjacent surface portions of the body of the vehicle. In a front lamp such as a headlamp, fog lamp or the like, a lens employed with the lamp often has portions inclined to the right and left so that the surface of the lens conforms to the design lines of the vehicle body. (See Japanese Patent Publication No. Hei. 3-222201, for example.) Further, since there is a tendency for vehicle body design lines to be rounded as a whole in order to satisfy aerodynamic, vehicle design and like requirements, the lenses of the front lamps, specifically, the portions of the lenses located adjacent the outer ends of the lamp in the widthwise direction of the vehicle, are often formed in a curved manner.

In such a case, in a lamp such as a headlamp which is disposed in a comparatively higher portion of the front end portion of the vehicle body, the lens of such a lamp is often formed in such a manner that the outer end portion of the lens in the widthwise direction of the vehicle is turned up or curved rearwardly from bottom to top (this curve will be hereinafter referred to as an upward curve), while, on the other hand, in a lamp such as a fog lamp which is disposed in a relatively lower position, the lens of such a lamp is often formed in such a manner that the outer end portion thereof is turned or curved rearwardly from top to bottom (this curve will be hereinafter referred to as a downward curve).

In the case of a headlamp, fog lamp and the like, generally, there are formed a plurality of horizontally diffusing lens steps in each of the lenses of such lamps. However, in a lamp having the above-mentioned upward curve or downward curve, if a plurality of horizontally diffusing lens steps are formed similarly to the case of lamps which have no such upward or downward curve, there arise problems as follows.

That is, the horizontally diffusing lens steps are generally formed in such a manner that, when the lens is viewed from ahead of the lamp, they are seen extending in the perpendicular direction. However, as shown in FIG. 7, for example, assuming that the outer end portion of a lens is formed in an upward curve, when the horizontally diffusing lens steps formed in such outer end portions are viewed from the horizontally diagonal and forward direction of the lamp, they are not seen extending in the perpendicular direction, but are seen extending obliquely so as to appear shifted rearwardly from bottom toward top. Therefore, as shown in FIG. 8, if reflected light from the reflector enters such upwardly curved portion from a horizontally inclined rearward direction (at a horizontal angle of $\alpha$ with respect to the optical axis Ax), then diffused light, which is obtained after the reflected light has passed through the horizontally diffusing lens steps, is not diffused in the horizontal direction but diffused in a direction at an angle of $\beta$ to the horizontal direction, because the horizontal diffusing lens steps are inclined at an angle of $\beta$ with respect to a perpendicular surface including the incident direction of the reflected light. That is, there arises a problem that a desired light distribution pattern cannot be obtained.

In this case, as shown in FIG. 9, even if, of a pair of reflecting surface areas respectively situated on the right and left sides of the reflector optical axis Ax, a reflecting surface area on the outer side in the widthwise direction of the vehicle is composed of a laterally diffusing curved surface that is, a curved surface structured so as to be able to reflect the light from a light source in such a manner that, the more distant a reflecting point is from the optical axis of the reflector in the lateral direction, the larger will be the lateral opening angle of the lamp with respect to the reflector optical axis. (This definition will apply similarly also in the following description of this specification.) Thus, even if the lens is arranged such that light incident on the outer end portion of the lens can be horizontally diffused to a certain degree, this horizontally diffused light is in fact diffused further in a direction at an angle of $\beta$ with respect to the horizontal direction by the above-mentioned horizontally diffusing lens steps. That is, similarly to the former case, there also arises a problem that a desired light distribution pattern cannot be obtained.

By allowing the reflected light from the reflector to enter the lens from the horizontally inclined rearward direction as in the above-mentioned manner can be used effectively in obtaining a required horizontally diffusion angle. That is, by providing a light diffusing function not only in the lens but also in the reflector, the lamp can be structured such that it has a reasonable light distribution function as a whole. Accordingly, this technique is often employed, especially in a fog lamp which must have a wide diffusion angle.

SUMMARY OF THE INVENTION

The present invention aims at eliminating the drawbacks found in the above-mentioned conventional vehicular lamp. Accordingly, it is an object of the invention to provide a vehicular lamp in which, when an upward or downward curve is provided in the outer end portion in the widthwise direction of the vehicle of a lens disposed in front of a reflector having respective portions inclined right and left, and also when a reflected light enters the lens outer end portion from diagonally to the rear, a desired light distribution pattern can be obtained by means of horizontally diffusing lens steps formed in the lens.

In attaining the above object, according to the invention, there is provided a vehicular lamp in which the angles of inclination of the horizontally diffusing lens steps that are situated in the outer end portion of the lens are improved.

According to a first embodiment of the invention, there is provided a vehicular lamp comprising a light source, a reflector having an optical axis extending in the longitudinal direction of the vehicle for reflecting the light from the light source forwardly, and a lens disposed in front of the reflector and having portions inclined right and left such that the outer end portion thereof in the widthwise direction of the vehicle is situated rearwardly of the inner end portion thereof, the lens including a portion which is located adjacent to the above-mentioned outer end portion and is curved in such a manner that it goes around rearwardly from bottom toward top. The lens further includes a plurality of horizontally diffusing lens steps formed parallel to one another, wherein the reflector is structured such that reflected light having a given lateral opening angle with respect to the optical axis is allowed to enter the outer end portion of the lens, and also wherein the horizontally diffusing lens steps positioned in the outer end portion of the lens are respectively formed such that, when the lens is viewed from ahead of the lamp, they appear curved and shifted from bottom toward top inwardly in the widthwise direction of the vehicle while their right and left widths are narrowed.

According to a second embodiment of the invention, there is provided a vehicular lamp comprising a light source, a reflector having an optical axis extending in the longitudinal direction of the vehicle for reflecting the light from the light source forwardly, and a lens disposed in front of the reflector and having respective portions inclined right and left such that the outer end portion thereof in the widthwise direction of the vehicle is situated rearwardly of the inner end portion thereof, the lens including a portion which is located adjacent the above-mentioned outer end portion and is curved in such a manner that it goes around rearwardly from top toward bottom, the lens further including a plurality of horizontally diffusing lens steps formed parallel to one another, wherein the reflector is structured such that reflected light having a given laterally opening angle with respect to the optical axis of the reflector enters the outer end portion of the lens, and also wherein the horizontally diffusing lens steps positioned in the outer end portion of the lens are formed such that, when the lens is viewed from ahead of the lamp, they appear curved and shifted from top toward bottom inwardly in the widthwise direction of the vehicle while their right and left widths are narrowed.

The reflector, which causes reflected light having the given lateral opening angle with respect to the optical axis of the reflector to enter the outer end portion of the lens, is not limited to the above-described structure. For example, part of the reflector may be composed of a paraboloid of revolution having a laterally facing axis, whereby parallel light is allowed to enter the outer end portion of the lens. Otherwise, the reflector may be composed of a laterally diffusing curved surface so that horizontally diffused light is allowed to enter the outer end portion of the lens.

According to the first and second embodiments of the invention, in a structure where the upward curve and downward curve are formed in the outer end portions of the lens portions disposed in front of the reflector and inclined right and left, and also in the case where the reflected light enters the outer end portions of the lenses from diagonally to the rear, the horizontally diffusing lens steps positioned in the outer end portions of the lenses are formed such that, when the lenses are viewed from ahead of the lamp, they appear curved and shifted inwardly in the widthwise direction of the vehicle from bottom toward top and from top toward bottom while their right and left widths are narrowed. With this structure, according to the present invention, the following operational effects are obtained.

That is, when the reflected light enters the outer end portions of the lenses having the upward curve and the downward curve from diagonally to the rear, in order to obtain horizontally diffused light by means of the horizontally diffusing lens steps formed in such portions, the horizontally diffusing lens steps may be formed in such a manner that they are seen extending in the perpendicular direction when viewed from the entering direction of the reflected light. The horizontally diffusing lens steps formed in this manner, when the lens is viewed from ahead of the lamp, do not appear to extend in the perpendicular direction but appear curved and shifted inwardly in the widthwise direction of the vehicle from bottom toward top and from top toward bottom while their right and left widths are narrowed. In other words, as in the first and second embodiments, if the respective horizontally diffusing lens steps positioned in the outer end portions are formed in such a manner that, when the lens is viewed from ahead of the lamp, they appear curved and shifted inwardly in the widthwise direction of the vehicle from bottom toward top and from top toward bottom while their right and left widths are narrowed, then the reflected light incident on these horizontally diffusing lens steps is allowed to pass and spread therethrough without being inclined with respect to the horizontal direction, thereby providing a horizontally diffused pattern.

Therefore, according to the first and second embodiments of the invention, in the case where the upward curve and downward curve are formed in the outer end portions of the lenses respectively disposed in front of the reflector and inclined right and left, and also in the case where the reflected light is incident on such outer end portions of the lenses, a desired light distribution pattern can be obtained by means of the horizontally diffusing lens steps formed in the lens in the above-described manner.

With use of the above-mentioned structure in which the lamp includes a reflector having a pair of reflecting surface areas respectively situated on the right and left sides of the optical axis and the reflecting surface area disposed on the outer side is composed of a laterally diffusing curved surface, in addition to the above operational effect, the following effect is obtained.

That is, as shown in FIG. 10, when a lens is inclined in the vertical direction, even if light reflected from the reflector passes horizontally through the horizontally diffusing steps formed in the lens, the transmissive diffused light of the reflected light cannot provide a horizontally spreading light distribution pattern. Specifically, as shown by a broken line in FIG. 10, if the lens is inclined in the upward direction (vertical inclination in which the upper portion of the lens is positioned rearwardly of the lower portion thereof), then the transmitted diffused light provides an inverted-U shaped light distribution pattern in which the right and left ends thereof are curved and shifted downward. On the other hand, as shown by a two-dot chain line in FIG. 10, if the lens is inclined in the downward direction (a vertical inclination in which the upper portion of the lens is positioned forwardly of the lower portion thereof), then the resultant diffused light provides a U-shaped light distribution pattern in which the right and left ends thereof are curved and shifted upwardly. As a result, there arises a problem that it is difficult to control the distribution of the light by the lens steps. Due to this factor, the lens is curved upward and downward respectively in the outer end portion, and, therefore, transmitted light which is diffused by the horizontally diffusing steps formed in such lens outer end portion provides an inverted-U shaped or a U-shaped light distribution pattern.

In view of this, if the reflecting surface area of the reflector on the outer side in the widthwise direction of the vehicle is composed of a laterally diffusing curved surface, then light reflected from the thus-formed reflecting surface area itself can enter the outer end portion of the lens at a certain horizontally diffused angle, although it is diffused on one side thereof, which reduces the horizontal diffusing load to be shared by the lens steps. That is, a set value for the diffusion angle by the horizontally diffusing steps of the lens can be kept within a small diffusion angle in which the effect of the above-mentioned curve and shift can be limited to a negligible range.

DESCRIPTION OF THE PREFERRED EMBODIMENTS

Figure 1:
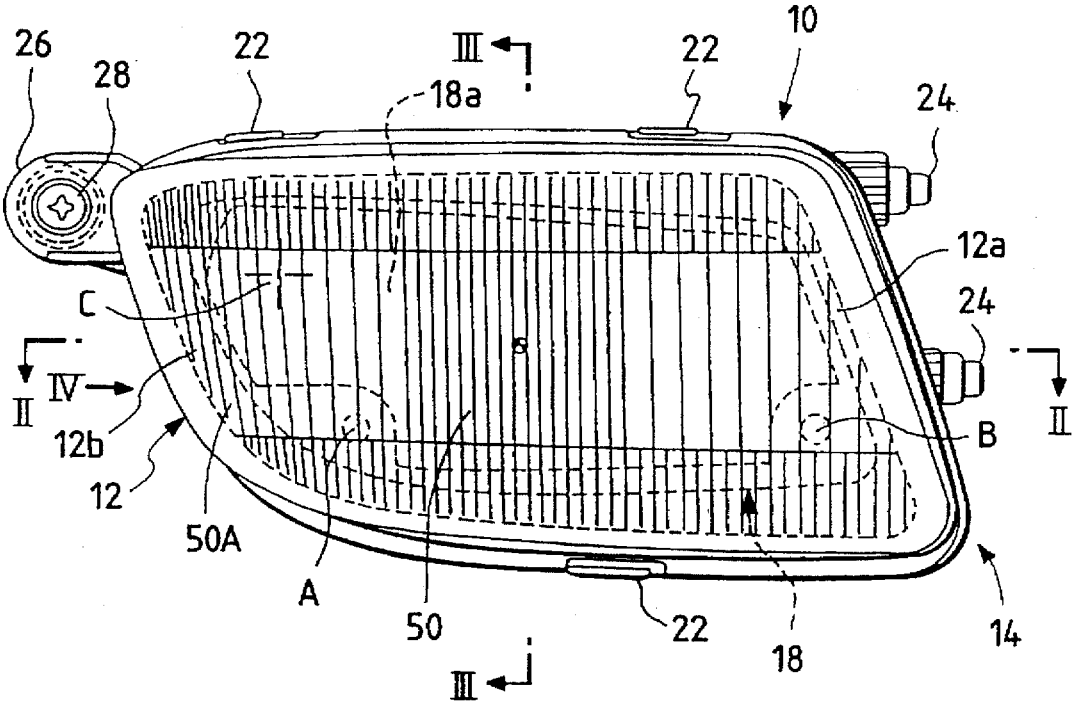
FIG. 1 is a front view of a preferred embodiment of a vehicular lamp according to the invention.
Figure 2:
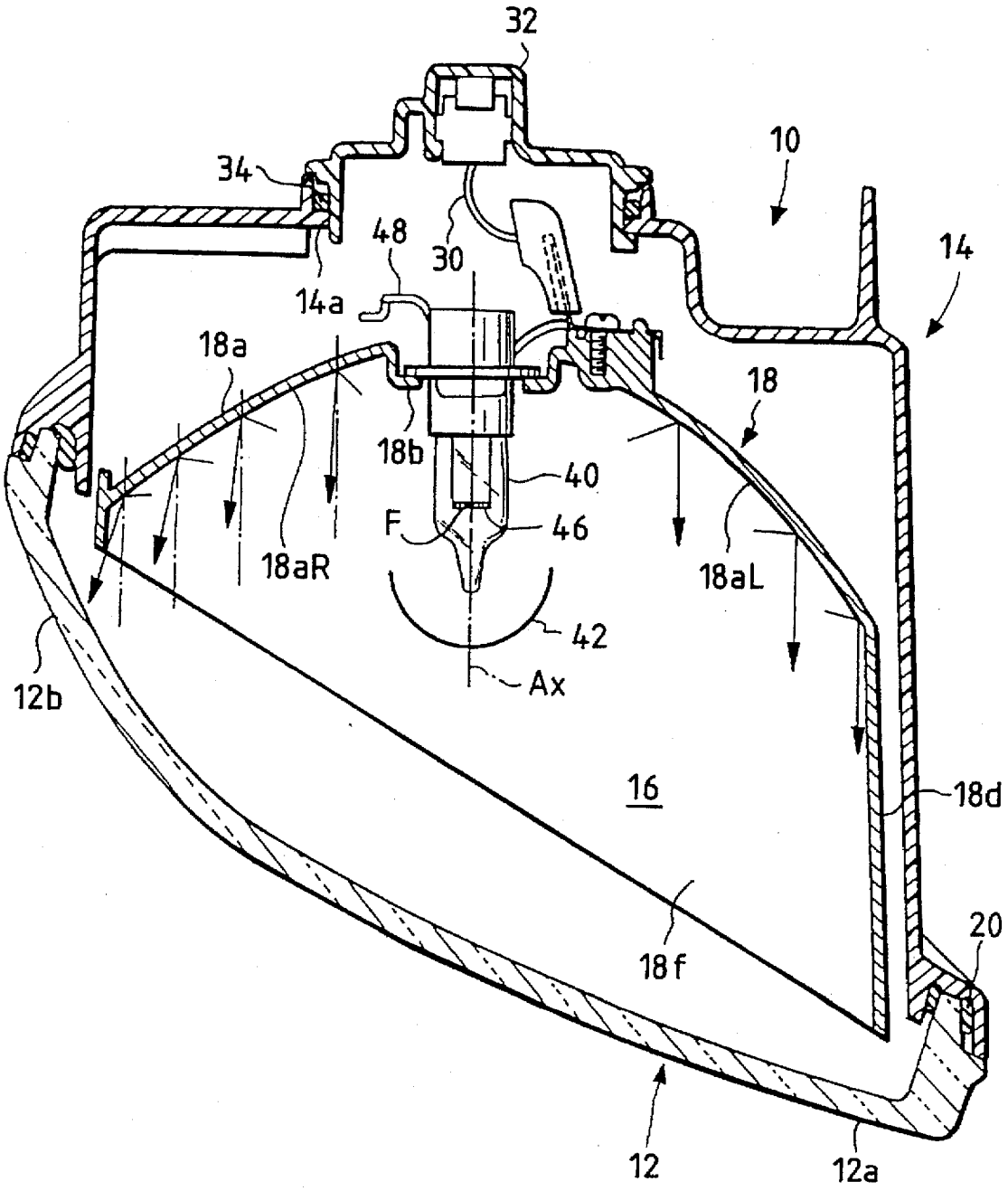
FIG. 2 is a sectional view taken along the line II—II shown in FIG. 1.
Figure 3:
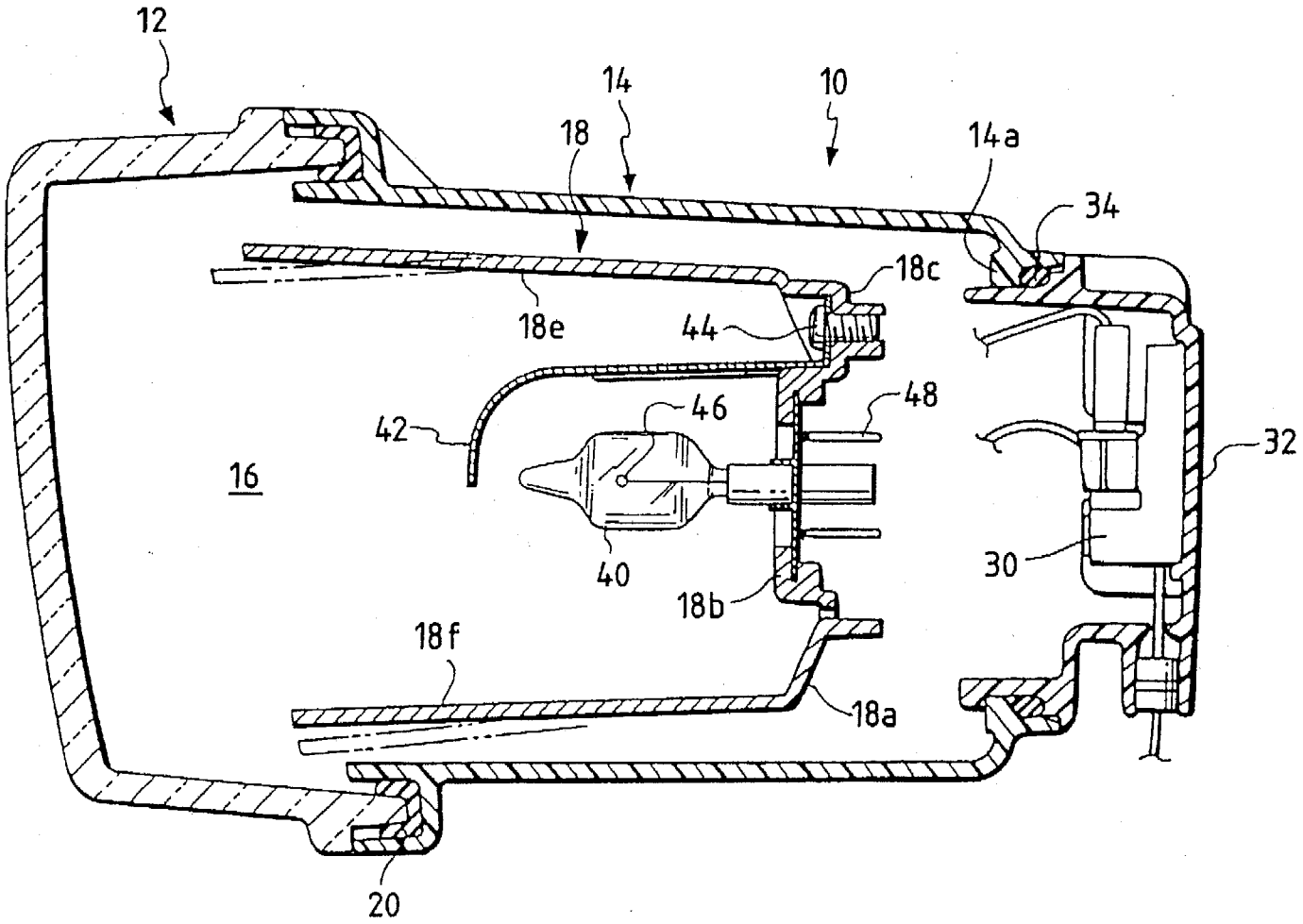
FIG. 3 is a sectional view taken along the line III—III shown in FIG. 1.
Figure 4:
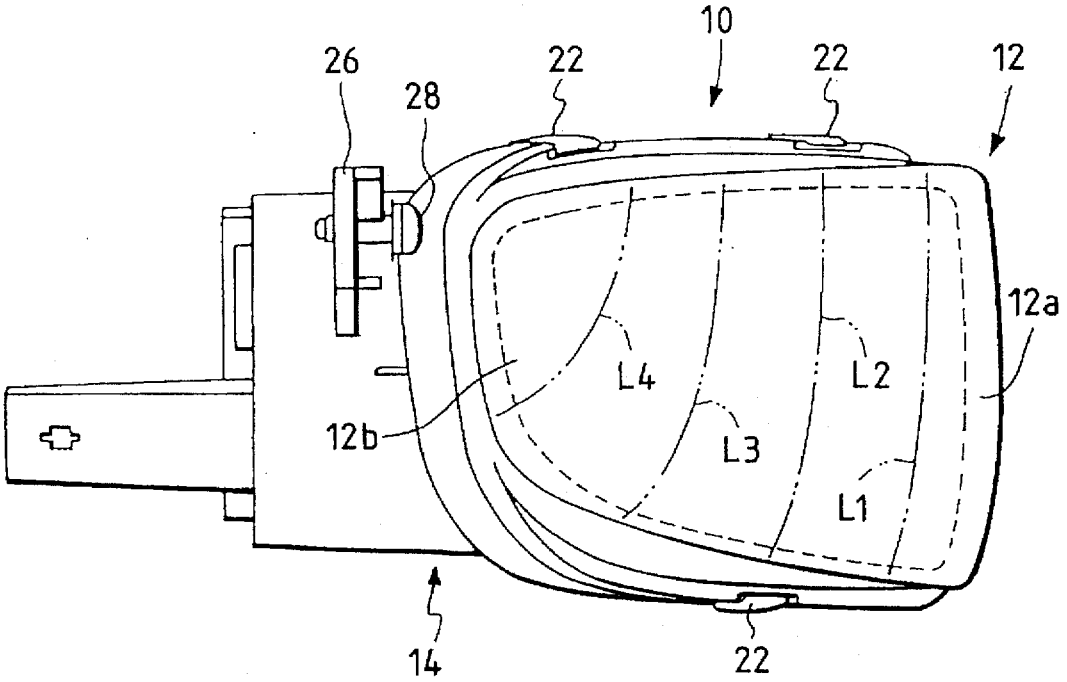
FIG. 4 is a lateral view taken in a direction of an arrow IV shown in FIG. 1.

A description will be given below of preferred embodiments of a vehicular lamp constructed according to the invention with reference to FIGS. 1 to 4 of the accompanying drawings, of which FIG. 1 is a front view of a preferred embodiment of a vehicular lamp according to the invention, FIG. 2 is a sectional view taken along the line II—II shown in FIG. 1, FIG. 3 is a sectional view taken along the line III—III shown in FIG. 1, and FIG. 4 is a lateral view of the present embodiment taken in the direction of an arrow IV shown in FIG. 1.

As shown in these drawings, the lamp of the present embodiment is a fog lamp disposed on the front right side of a vehicle. A fog lamp disposed on the left side of the vehicle is bilaterally symmetrical in structure to the right-side fog lamp.

This fog lamp 10 includes an aiming mechanism of the movable reflector type whereby a reflector 18, mounted in a cavity 16 defined by a lens 12 and a body 14, can be tilted in the vertical direction. Specifically, the reflector 18 is connected to the body 14 at points A and B shown in FIG. 1 in such a manner that it can be inclined in the vertical direction. The reflector 18 is also connected to the body 14 at a point C shown in FIG. 1 in such a manner that it can also be shifted in the front-and-rear direction thereof. In this structure, by applying an external force to the reflector 18 at the point C in the front-and-rear direction, the reflector 18 can be inclined in the vertical direction about a horizontal axis which connects the points A and B with each other.

The lens 12 includes a base end portion which is bonded through a sealing agent 20 to the body 14 over the whole periphery thereof. Also, the lens 12 is mounted to the body 14 through clips 22 provided at the two upper positions and one lower position of the base end portion.

The lens surface of the lens 12, as shown in FIG. 2, has respective portions strongly inclined to right and left so that the outer end portion **12*b* in the widthwise direction of the vehicle (in FIG. 2, the right end portion) of the lens 12 is situated to the rear of the inner end portion 12*a* (in FIG. 2, the left end portion) of the lens 12. Also, the lens surface, as shown in FIG. 3, is slightly inclined in the vertical direction (downward inclination) as well such that the upper portion thereof is situated in front of the lower portion thereof. The angle of this downward inclination, as can be seen clearly also from virtual longitudinal section lines L1, L2, L3 and L4, which are drawn at a plurality of positions in the widthwise direction of the vehicle on the lens surface and are respectively shown by two-dot chain lines in FIG. 4, increases gradually from the inner end portion 12*a* of the lens surface toward the outer end portion 12*b* thereof. In the portion of the lens surface adjacent the outer end portion 12*b***, the downward inclination angle is of the order of 45°.

The body 14, as shown in FIG. 1, can be mounted on a vehicle body through a pair of upper and lower bosses 24 formed integrally with the inner side in the widthwise direction of the vehicle portion of the body 14 and also through a screw 28 in threaded engagement with a bracket 26 formed integrally with the outer side of the vehicle portion of the body 14. Also, as shown in FIGS. 2 and 3, a cover 32 with a harness 30 incorporated therein is mounted through an O-ring 34 in an opening **14*a* formed in the rear portion of the body 14** for replacement of the bulb.

The reflector 18 is formed of die cast aluminum, and, as shown in FIGS. 2 and 3, includes a reflecting surface forming portion **18*a* which forms the reflecting surface of the reflector 18, and a socket base portion 18*b* on which a bulb 40 can be mounted. The two portions 18*a* and 18*b* are formed integrally with each other. Above the socket base portion 18*b*, there is provided a shade mounting portion 18*c* used to fix a shade 42 to the reflector 18 through a screw 44. The bulb 40 is a halogen bulb of the so-called C-6 type, and includes a filament coil 46 which has an axis extending in the right-and-left direction. The bulb 40 is positioned and fixed to the socket base portion 18*b* by means of a line spring 48**.

The reflecting surface forming portion **18*a* includes two right-and-left areas with a perpendicular surface including the optical axis Ax of the reflector 18 as the boundary thereof, while the right-and-left areas are formed as curved surfaces which are mutually different in shape from each other. That is, the left reflecting surface area 18*a*L situated on the left side of the optical axis Ax has the shape of a paraboloid of revolution, whereas the right reflecting surface area 18*a*R situated on the right side of the optical axis Ax is composed of a laterally diffusing curved surface. This laterally diffusing curved surface, as shown in FIG. 2, is a curved surface which reflects incident light from the filament coil 46** serving as a light source in such a manner that the more distant the reflecting point is from the optical axis Ax in the lateral direction, the larger the reflection angle is with respect to the optical axis Ax. (Above-mentioned Japanese Patent Publication No. Sho. 59-53641 discloses a method for determining such a laterally diffusing curved surface by deforming a paraboloid of revolution, and thus a detailed description of such a technique is omitted here. However, it should be noted here that the degree of deformation of the paraboloid of revolution in setting the laterally diffusing curved surface is set to a value which is equivalent to the right-and-left inclination angle of the lens.)

The focal position of the paraboloid of revolution forming the left reflecting surface area **18*a*L and the focal position of the laterally diffusing curved surface forming the right reflecting surface area 18*a*R are both set at a point F on the optical axis Ax, and both of the focal distances of the paraboloid of revolution and laterally diffusing curved surface are set to the same value. The front-and-rear position of the bulb mounting seat surface in the socket base portion 18***b* is set in such a manner that the filament coil 46 of the bulb 40 can be positioned at the focal position F.

The reflector 18 also includes a side wall portion 18*d* which extends in the longitudinal direction thereof and is connected to the left side edge of the left reflecting surface area 18*a*L, and the reflector 18 further includes an upper wall portion 18*e* and a lower wall portion 18*f* having a front end edge inclined respectively to the right and left in correspondence with the right-and-left inclined portions of the lens 12, while the upper and lower wall portions 18*e* and 18*f* are connected to the side wall portion 18*d*. The reason for provision of the side wall portion 18*d*, upper wall portion 18*e* and lower wall portion 18*f* is to improve the appearance of the lamp by providing as much lustrous surface area as possible.

As shown in FIG. 1, on the inside of the lens surface of the lens 12, there are formed a plurality of horizontally diffusing lens steps 50. The horizontally diffusing lens steps 50 are respectively formed in such a manner that, when the lens 12 is viewed from ahead of the lamp, they are seen extending in the perpendicular direction. However, of the lens steps 50, the horizontally diffusing lens steps 50A situated in the portion of the lens 12 located adjacent to the outer end portion 12*b* of the lens 12 in the widthwise direction of the vehicle are formed in such a manner that, when the lens 12 is viewed from ahead of the lamp, they can be seen curved and shifted from top toward bottom inwardly in the widthwise direction of the vehicle while their right and left widths are narrowed.

Figure 5:
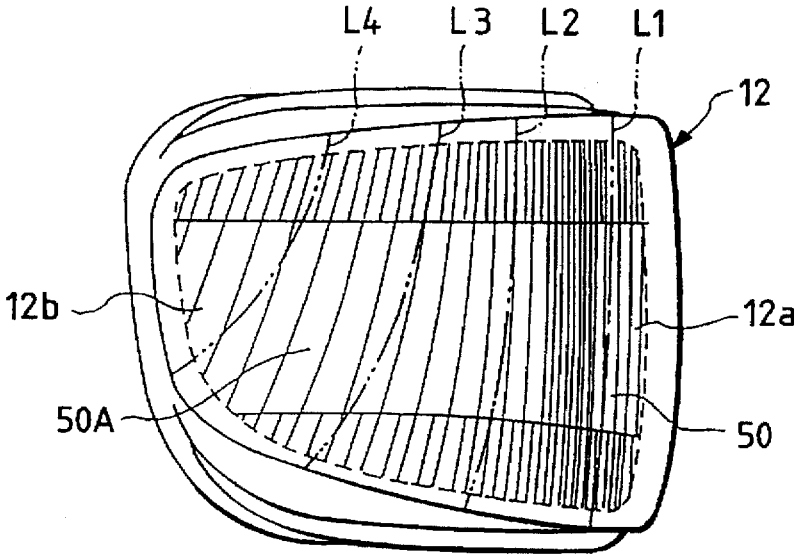
FIG. 5 is a right side view of a lens which is employed in the present embodiment (but is shown here separately)

FIG. 5 is a view of the lens 12 showing a state in which the lens 12 is viewed from the right side of the lamp. As shown in FIG. 5, the respective horizontally diffusing lens steps 50A situated in the outer end portion 12*b* of the lens 12 when the lens 12 is viewed from the right side of the lamp are seen extending obliquely in such a manner that they are shifted rearwardly in position from top toward bottom along with the downward curve of the lens 12. As can be clearly understood from FIG. 5, the angle of inclination of the lens steps 50A is smaller than the angle of inclination of L3 or L4 (see FIG. 4) showing the state of the curvature of the lens 12 itself, and the angle of inclination of the lens steps 50A is also corrected to a side which approaches the perpendicular direction. This deviation in the angle of inclination corresponds to the tapered curve and shift extending from top toward bottom inwardly in the widthwise direction of the vehicle of the horizontally diffusing lens steps 50A when the lens 12 is viewed from ahead of the lamp. This deviation in the angle of inclination is obtained as a result of the arrangement of the horizontally diffusing lens steps 50A in that they are formed so as to extend in the perpendicular direction when viewed from the incident direction of the reflected light.

As has been described in detail heretofore, according to the present embodiment, when a downward curve is formed in the outer end portion 12*b* of the lens 12 arranged in front of the reflector and having portions inclined in the right and left direction, and also when the reflected light is allowed to enter the outer end portion 12*b* of the lens 12 from diagonally to the rear, the horizontally diffusing lens steps 50A situated in the outer end portion 12*b* adjacent portion of the lens 12 are respectively formed in such a manner that, when the lens 12 is viewed from ahead of the lamp, they appear curved and shifted from top toward bottom inwardly in the widthwise direction of the vehicle while their right and left widths appear narrowed. As a result, there can be obtained the following operational effects.

When the reflected light enters the downward curved outer end portion 12*b* of the lens 12 from horizontally diagonally to the rear, in order to obtain horizontally diffused light by means of the horizontally diffusing lens steps 50A formed in the downwardly curved outer end portion of the lens 12, the horizontally diffusing lens steps 50A may be formed in such a manner that they are seen extending in the perpendicular direction when viewed from the incident direction of the reflected light. The thus-formed horizontally diffusing lens steps 50A, when the lens 12 is viewed from the front side of the lamp, do not appear to extend in the perpendicular direction, but they appear curved and shifted from top toward bottom inwardly in the widthwise direction while their right and left widths appear narrowed. In other words, if the horizontally diffusing lens steps 50A situated in the outer end portion are formed in such a manner that, when the lens 12 is viewed from ahead of the lamp, they appear curved and shifted from top toward bottom inwardly in the widthwise direction of the vehicle while their right and left widths appear narrowed, then the reflected light incident on these horizontally diffusing lens steps 50A is allowed to pass and spread therethrough without being inclined with respect to the horizontal direction, thereby providing a horizontally diffused pattern.

Therefore, according to the present embodiment, when a downward curve is provided in the outer end portion 12*b* of the lens 12 disposed in front of the reflector 18 having portions inclined right and left, and also when the reflected light enters the outer end portion 12*b* of the lens 12 from diagonally to the rear, it is possible to obtain a desired light distribution pattern by means of the horizontally diffusing lens steps 50 (including lens steps 50A) formed in the lens 12.

Also, according to the present embodiment, since the right reflecting surface area 18*a*R of the reflector 18 situated on the outer side in the widthwise direction of the vehicle of the optical axis Ax is composed of a laterally diffusing curved surface, in addition to the above-mentioned operational effect, there can be obtained the following operational effects.

Figure 10:
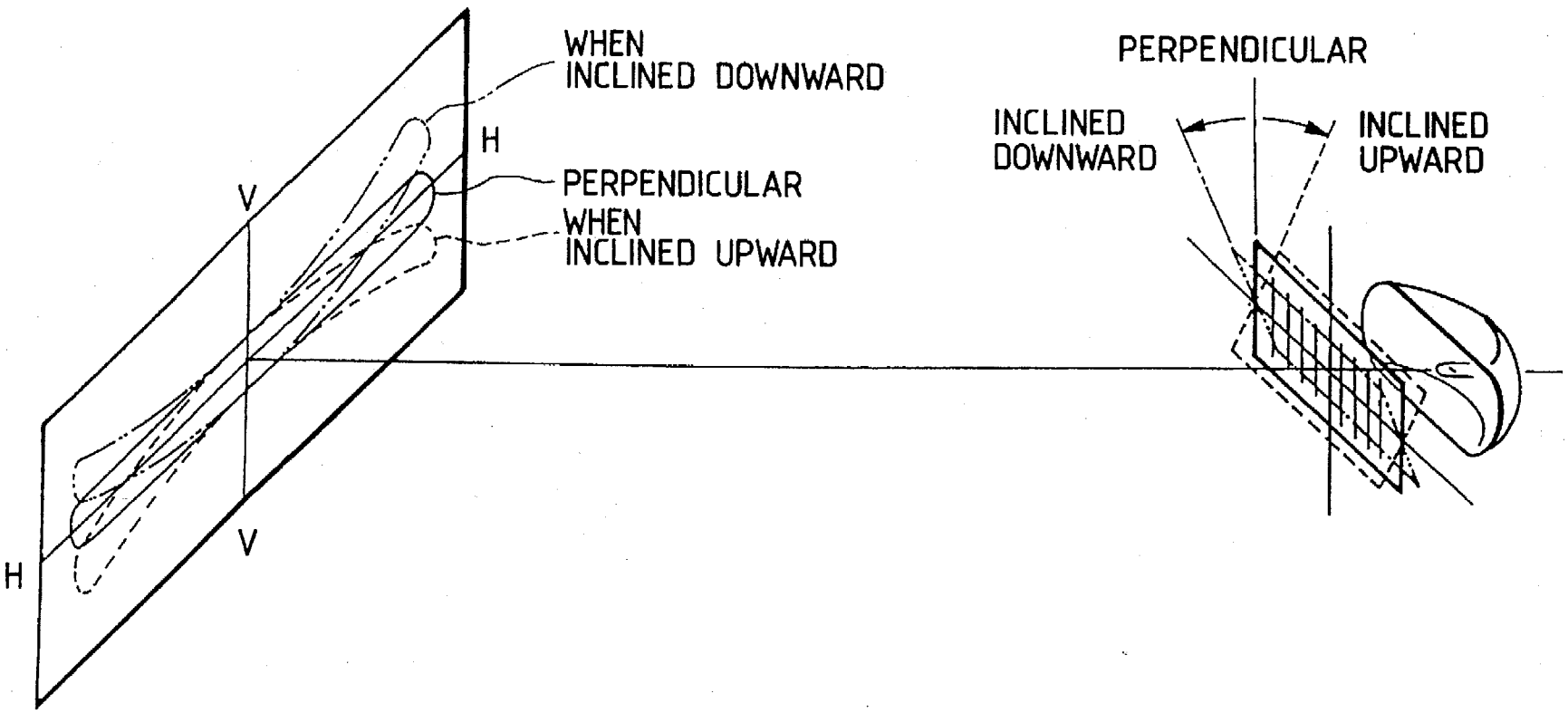
FIG. 10 is a perspective view of a conventional lamp, illustrating the problem to be solved by the invention (in particular, showing a relationship between a lens vertical inclination angle and a light distribution pattern curve).

That is, according to the present embodiment, since the outer end portion 12*b* of the lens 12 is curved downward, the lens 12 is inclined downwardly in this portion. Therefore, in the transmission light diffused by the horizontally diffusing lens steps 12A formed in this portion, even if the diffused direction thereof is corrected to extend in the horizontal direction by means of the above-mentioned inclination angle correction, it is inevitable that a U-shaped light distribution pattern will be generated due to the horizontal diffusion thereof (see FIG. 10).

Figure 6:
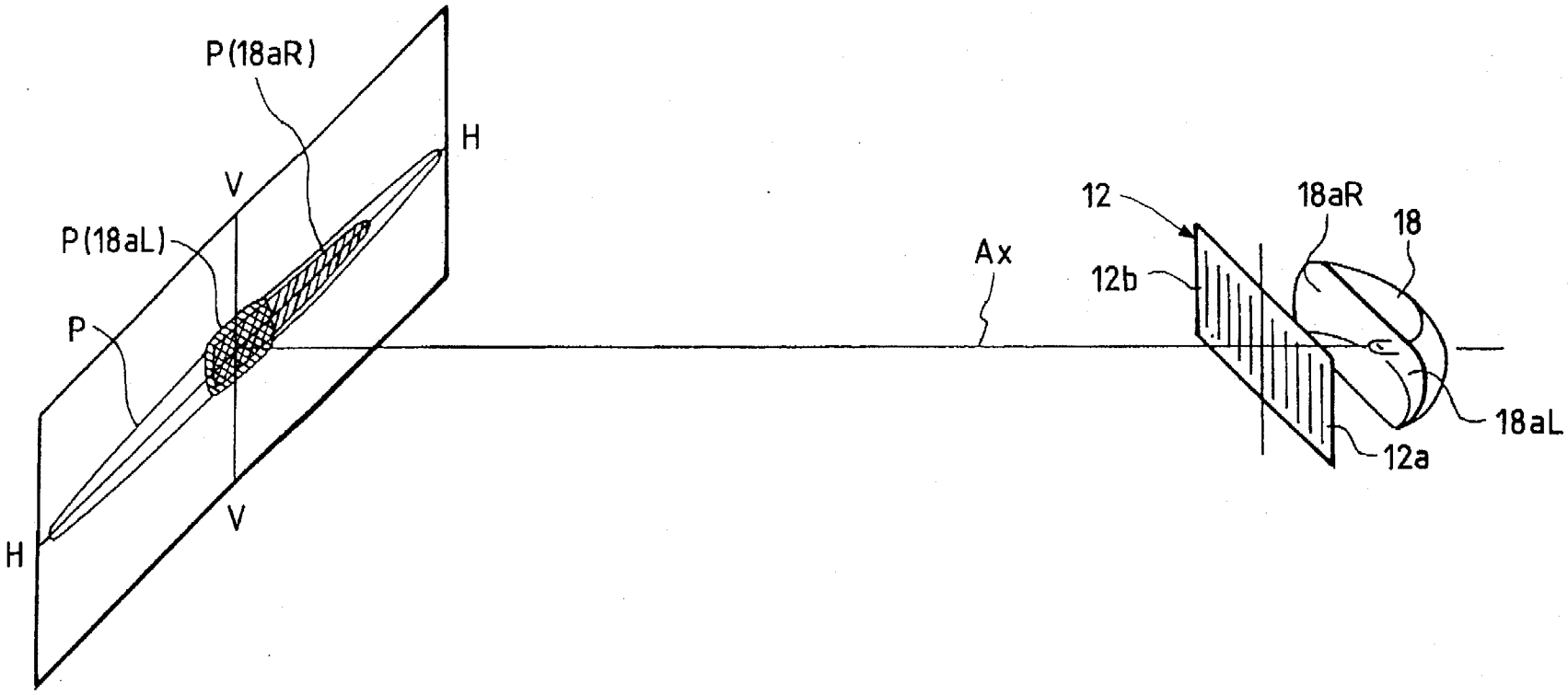
FIG. 6 is a perspective view of the present embodiment, illustrating the operation thereof.
Figure 7:
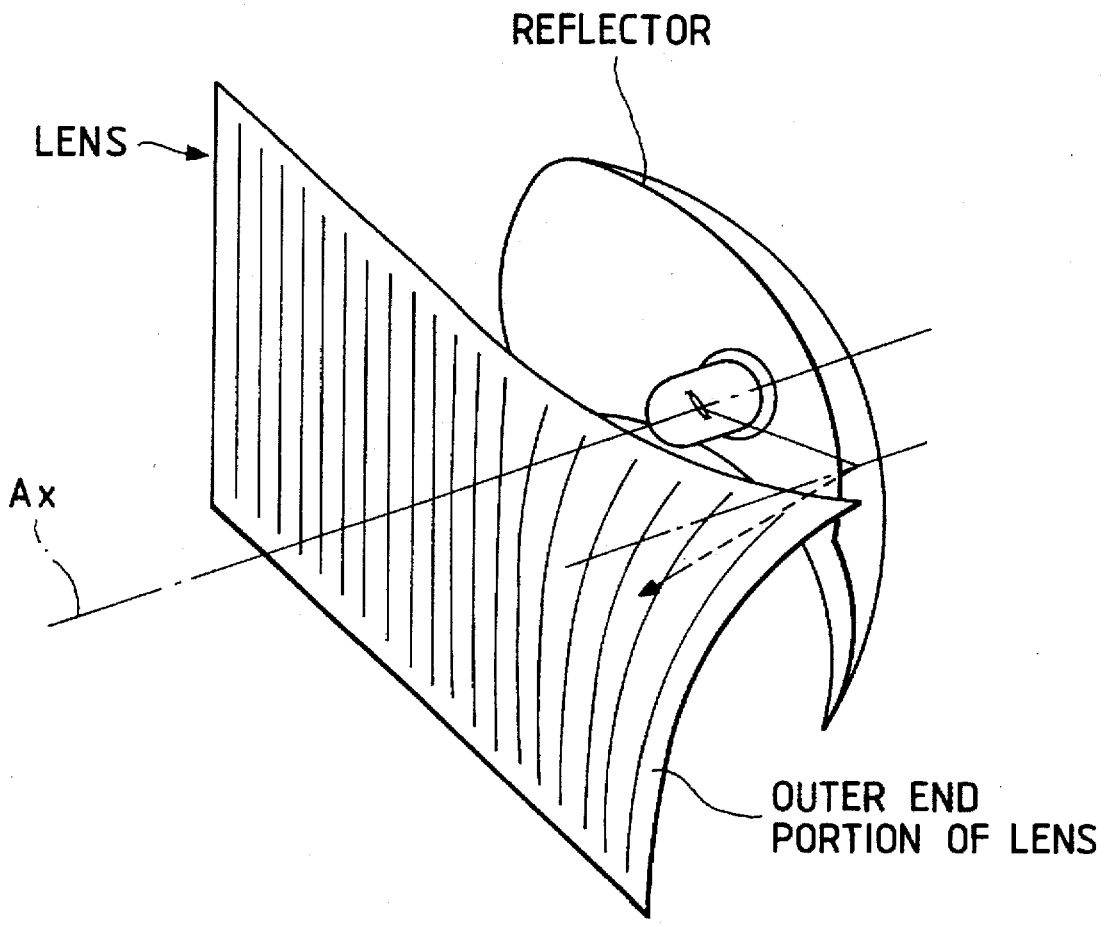
FIG. 7 is a perspective view of a conventional lamp, illustrating the problem to be solved by the invention (in particular, showing how reflected light enters the upward curved portion of a lens)
Figure 8:
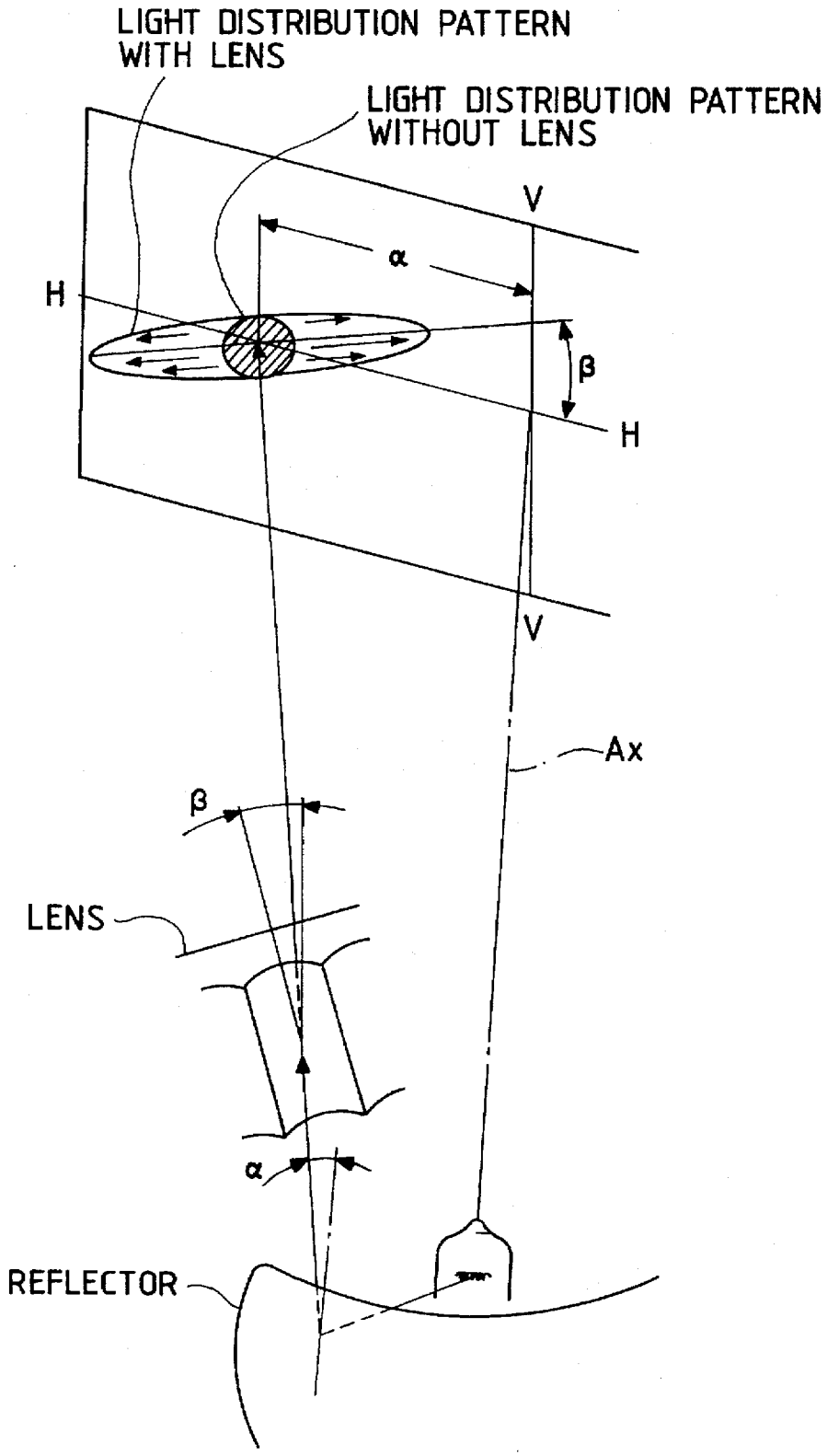
FIG. 8 is a perspective view of a conventional lamp, illustrating the problem to be solved by the invention (in particular, showing a first lamp distribution pattern which is obtained by a transmission light through the upward curved portion of the lens)
Figure 9:
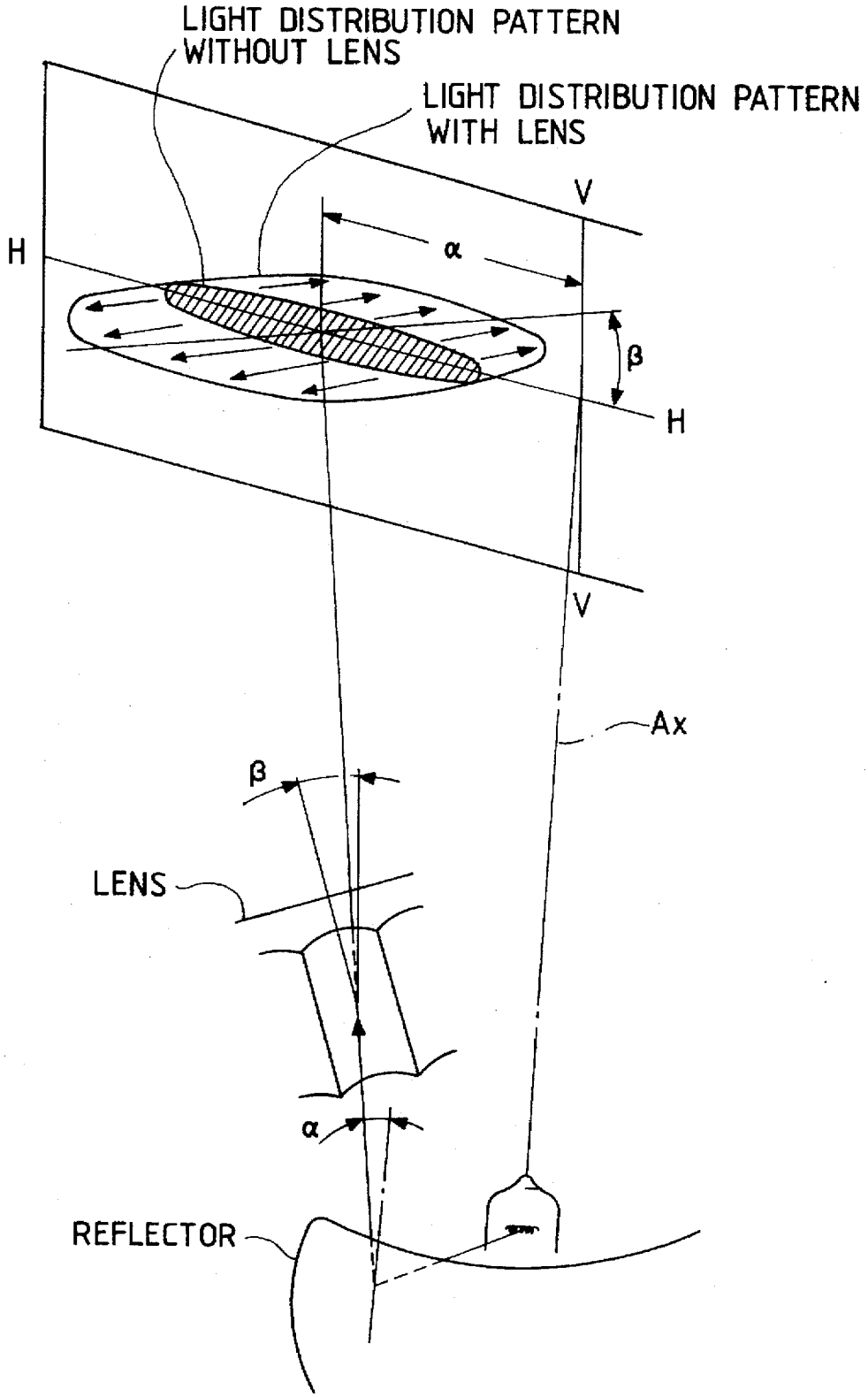
FIG. 9 is a perspective view of a conventional lamp, illustrating the problem to be solved by the invention (in particular, showing a second light distribution pattern which is obtained by a transmission light through the upward curved portion of the lens)

On the other hand, as illustrated in FIG. 6, in a state in which the lens 12 is removed, the reflected light from the left reflecting surface area 18*a*L formed as a paraboloid of revolution is radiated as a substantially parallel light beam toward the front surface, that is, the reflected light is radiated as a spot-like pattern P (18*a*L), whereas the reflected light from the right reflecting surface area 18*a*R formed as a laterally diffusing curved surface is radiated as a pattern P (18*a*R) which is diffused from the front surface direction in the rightward direction at an angle which is horizontally diffused to a certain degree.

Accordingly, when the lens 12 is disposed in front of the reflector 18 so as to provide a light distribution pattern P for a fog lamp, in front of the right reflecting surface area 18*a*R, even if lens steps are not formed in-the lens 12 for obtaining a large horizontally diffused angle, there can be obtained a desired right-direction diffused angle. For this reason, according to the present embodiment, the generation of the U-shaped lamp distribution pattern can be minimized.

As shown in FIG. 6, for the purpose of simplified explanation, the lens 12 and reflector 18 are shown in a typical manner, that is, the lens 12 is not inclined right and left and the reflector 18 is not inclined in the vertical direction.

A description has been given heretofore of the fog lamp 10 which includes a downward curve in the outer end portion **12*b* of the lens 12. However, the present invention is not limited to this arrangement. That is, in a fog lamp or other similar lamp including an upward curve in the above-mentioned lens end portion 12*b*, if the horizontally diffusing lens steps 50A situated in the outer end portion 12*b* of the lens 12 are formed in such a manner that, when the lens 12** is viewed from ahead of the lamp, oppositely to the above-mentioned embodiment, they appear curved and shifted from bottom toward top inwardly in the vehicle width direction while their right and left widths are narrowed, then it is possible to obtain a similar operational effect to the above-described embodiment.

What is claimed is:

1. A vehicular lamp comprising: a light source; a reflector having an optical axis extending in the longitudinal direction of a vehicle on which said lamp is mounted for reflecting light from said light source forwardly; and a lens disposed in front of said reflector and having portions inclined right and left in such a manner that an outer end portion of said lens in a widthwise direction of said vehicle is situated rearwardly of an inner end portion of said lens in said widthwise direction of said vehicle, at least a portion of said outer end portion being curved and shifted rearwardly from bottom toward top, and said lens further comprising a plurality of horizontally diffusing lens steps formed in parallel to one another, wherein reflected light having a given lateral opening angle with respect to said axis enters said vehicle outer end portion of said lens, and also wherein said plurality of horizontally diffusing lens steps are formed in such a manner that, when said lens is viewed from ahead of said lamp, said lens steps appear curved and shifted from bottom toward top inwardly in said widthwise direction while right and left widths of said lens steps appear narrowed.

2. A vehicular lamp as set forth in claim 1, wherein, said reflector comprises a pair of reflecting surface areas respectively situated on right and left sides of said optical axis, wherein a reflecting surface area situated on an outer side of said reflector in said widthwise direction of said vehicle comprises a curved surface reflecting light from said light source in such a manner that the more distant a reflecting point is from said optical axis in a lateral direction of said reflector, the larger said lateral opening angle is with respect to said optical axis.

3. A vehicular lamp as set forth in claim 1, wherein an angle of inclination of said lens steps in the curved part of said outer portion is smaller than an angle of inclination of lines following the curvature of said lens in said outer portion.

4. A vehicular lamp comprising: a light source; a reflector having an optical axis extending in the longitudinal direction of a vehicle on which said lamp is mounted for reflecting light from said light source forwardly; and a lens disposed in front of said reflector and having portions inclined right and left in such a manner that an outer end portion of said lens in a widthwise direction of said vehicle is situated rearwardly of an inner end portion of said lens in said widthwise direction of said vehicle, at least a portion of said outer end portion being curved and shifted rearwardly from top toward bottom, and said lens further comprising a plurality of horizontally diffusing lens steps formed in parallel to one another, wherein reflected light having a given lateral opening angle with respect to said axis enters said vehicle outer end portion of said lens, and also wherein said plurality of horizontally diffusing lens steps are formed in such a manner that, when said lens is viewed from ahead of said lamp, said lens steps appear curved and shifted from top toward bottom inwardly in said widthwise direction while right and left widths of said lens steps appear narrowed.

5. A vehicular lamp as set forth in claim 4, wherein, said reflector comprises a pair of reflecting surface areas respectively situated on right and left sides of said optical axis, wherein a reflecting surface area situated on an outer side of said reflector in said widthwise direction of said vehicle comprises a curved surface reflecting light from said light source in such a manner that the more distant a reflecting point is from said optical axis in a lateral direction of said reflector, the larger said lateral opening angle is with respect to said optical axis.

6. A vehicular lamp as set forth in claim 4, wherein an angle of inclination of said lens steps in the curved part of said outer portion is small than an angle of inclination of lines following the curvature of said lens in said outer portion.

* * * * *